US005832687A

United States Patent [19]

Willemsen

[11] Patent Number: 5,832,687

[45] Date of Patent: Nov. 10, 1998

[54] COUPLING MEANS FOR BUILDING BLOCK

[76] Inventor: Thomas Willemsen, 961 Newells Lane, Athens, Ontario, Canada, K0E 1B0

[21] Appl. No.: 606,997

[22] Filed: Feb. 26, 1996

Related U.S. Application Data

[63] Continuation-in-part of Ser. No. 201,327, Feb. 24, 1994, Pat. No. 5,493,816.

[51] Int. Cl.[6] ..... F04C 1/00

[52] U.S. Cl. ..... 52/592.6; 52/569; 52/598; 52/603; 52/604; 446/125; 446/478; 446/487; 446/104

[58] Field of Search ..... 52/569, 598, 592.6, 52/604, 603; 446/104, 125, 478, 487

[56] References Cited

U.S. PATENT DOCUMENTS

| | | | |
|---|---|---|---|
| 2,649,803 | 8/1953 | Andre | 446/104 |
| 3,083,877 | 4/1963 | Gash | 5/449 X |
| 3,256,440 | 6/1966 | Stark | 52/2.11 X |
| 4,267,662 | 5/1981 | Gordy | 446/89 |
| 5,230,195 | 7/1993 | Sease | 52/603 X |
| 5,493,816 | 2/1996 | Willemsen | 52/2.11 |

*Primary Examiner*—Christopher Kent

[57] ABSTRACT

A building block is provided with coupling means on the upper and lower faces allow the blocks to be interconnected to form structures. The coupling means includes protrusions on one face and a set of sockets or receptacles sized to engage the protrusions formed on the opposite face. The sockets are preferably laid-out in two cross-like formations of four sockets each and optionally may include a further two central sockets disposed between the two cross-like formations.

2 Claims, 5 Drawing Sheets

COUPLING MEANS FOR BUILDING BLOCK

This application is a Continuation-In-Part filing of U.S. application Ser. No. 08/201,327 filed 24 Feb., 1994 and issued as U.S. Pat. No. 5,493,816 on 27 Feb., 1996.

FIELD OF THE INVENTION

This invention relates to building materials and particularly stackable blocks. More specifically, the invention includes a coupling system for building blocks which are particularly suited as toys for children, but industrial applications exist for the invention as well.

BACKGROUND OF THE INVENTION

Building blocks are known which have a series of protrusions on one side and recesses or sockets on the opposite side for interfitting with the protrusions. The object of such coupling systems is to provide blocks which can be interconnected in a variety of fashions It is desirable to provide interfitting coupling blocks that can be assembled to provide a planar wall of overlapping blocks in consecutive courses, a wall with curvature and transverse or intersecting wall intersections. It is with these objects in mind that the following invention has been conceived.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

In its more general sense the invention comprises a stackable building block for constructing a structure, the blocks have top and bottom faces that are preferably generally horizontally oriented. These faces are provided with complementary connector or coupling means in the form of protrusions and depressions formed on the respective top and bottom faces, whereby the blocks can be laid in interfitted courses to form a more stable structure. The protrusions and depressions are positioned so that the blocks may be staggered to increase their interlocking strength. Additionally, the protrusions and depressions are positioned to permit construction of walls having corners, and angular deflections from the shape of a simple plane structure. This may include both fixed 90 degree deflections and a range of other deflections extending upwards from zero degrees.

A feature of the invention is that on one face of the block are formed at least two protrusions, and on the other face of the block are formed at least six, preferably eight, more preferably 10, depressions in the form of receptacles dimensioned to interfit and engage with the protrusions. The protrusions are located along the median longitudinal plane of the block, symmetrically positioned about the transverse median plane. The receptacles are preferably deployed in a pattern of two cross-like formations to provide four receptacles that are located along the median longitudinal plane of the block and four receptacles that are symmetrically positioned about the transverse median plane of the block.

While shown as sockets, the receptacles may also be in the form of channels, preferably laid-out in the double-cross-like formations, wherein the channels are dimensioned to inter-engage with the protrusions.

Optionally, two further receptacles may be positioned along the transverse median plane of the block, symmetrically about the longitudinal median plane.

A block may also be formed wherein the receptacles are deployed in a pattern of six, with two receptacles positioned along the median line formed by the median longitudinal plane passing through the block symmetrically about the transverse median plane of the block; and the remaining four receptacles positioned in pairs along two transverse planes that correspond with the two outside quarters of the block. These four receptacles, located along such quartering planes, are also positioned symmetrically about the median longitudinal plane.

A block with this minimum number of receptacles may be engaged by the protrusion of an adjacent block positioned off either end of the block carrying the six receptacles or positioned to extend outwardly from the four half-side faces of the block. It may be engaged by a block with only two protrusions; or by a block with four protrusions. In the latter case only the outer protrusions will be used in such engagement.

A preferred manner for fabricating the blocks of the invention is by blow-molding. However, other known suitable fabrication means may alternately be employed.

The foregoing summarizes the principal features of the invention and some of its optional aspects. The invention may be further understood by the description of the preferred embodiments, in conjunction with the drawings, which now follow.

BRIEF DESCRIPTION OF THE DRAWINGS

In drawings which illustrate the embodiments of the invention.

DESCRIPTION OF PREFERRED EMBODIMENTS

Figure 1:
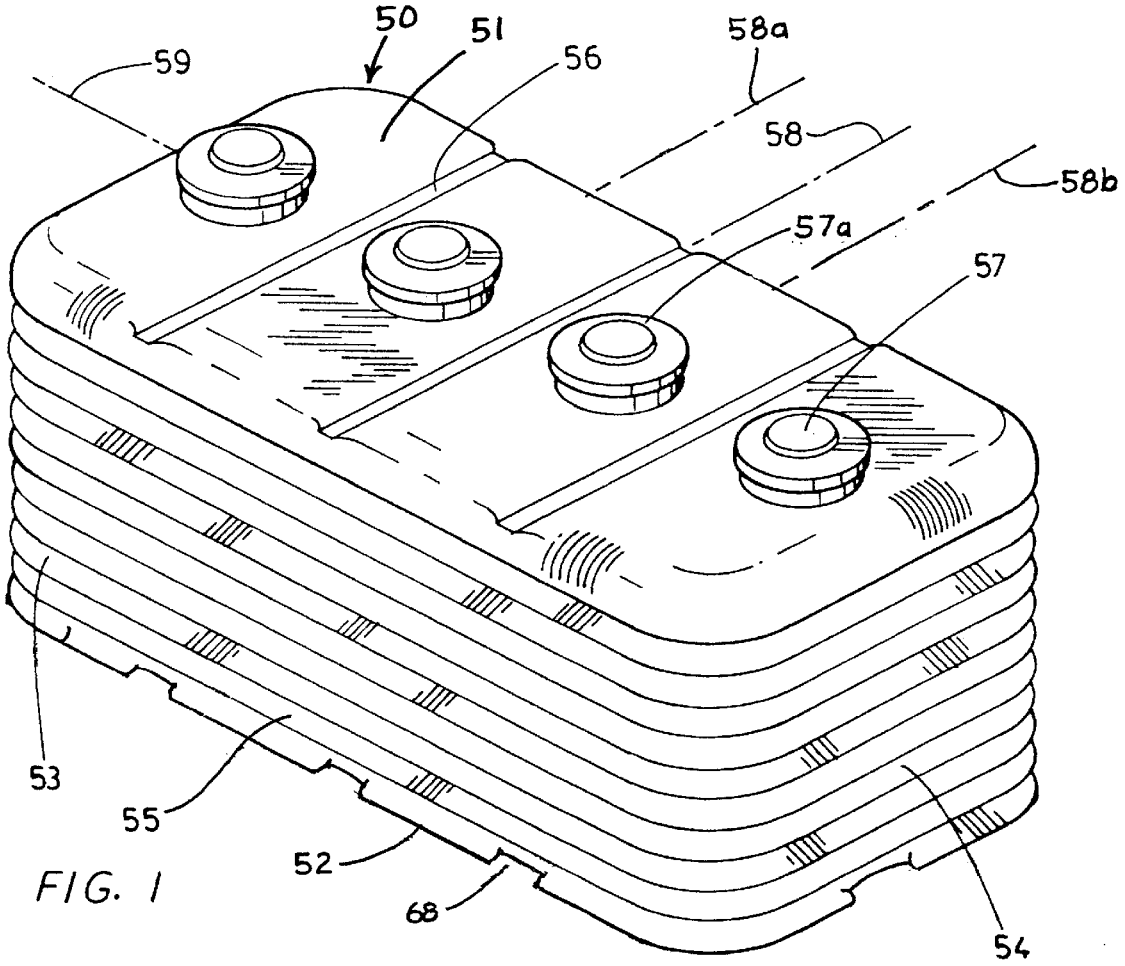
FIG. 1 is a perspective view of an embodiment of a block with coupling means according to the invention.
Figure 3:
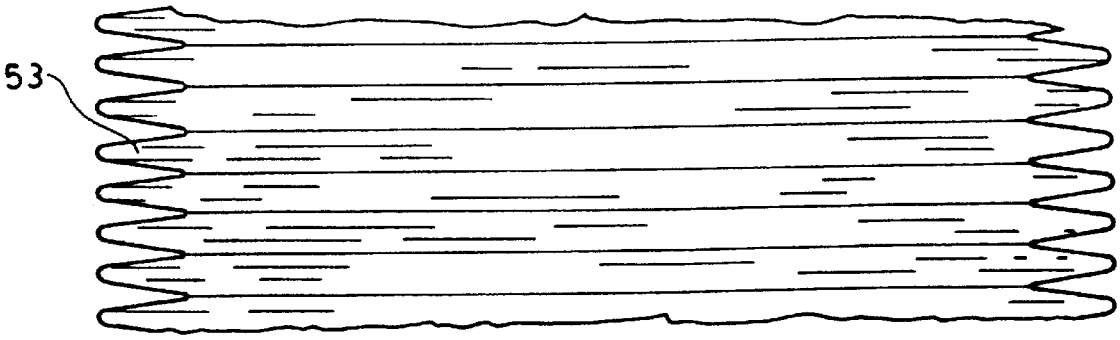
FIG. 3 is a partial end view of the block of FIG. 2, with the block partially collapsed.

FIG. 1 shows a perspective view of a block with preferred, pleated accordion-like sides 53. The block 50 has relatively flat top 51 and bottom 52 faces with outwardly directed exterior surfaces in the form of panels which are sufficiently thick to be relatively stiff. The encircling sides 53 delimiting the boundaries of the top 51 and bottom 52 faces have end 54 and face portions 55 which are conveniently pleated in an accordion-like manner to permit folding and compression of the sides 53, thereby to provide for the collapse of the block, as shown in FIG. 3. Bottom face 8 contains an air fluid valve 12.

While an air-filled, collapsible block is shown these characteristics are not essential features of the invention. The invention resides in the coupling means employed.

This collapsible block 50 is preferably blow-molded from polyethylene or polypropylene plastic, with a side-wall thickness on the order of 1 millimeter and preferably a thickness of 1–3 mm in the top 51 and bottom 52 panels. Inset ribs 56 may optionally traverse the top 51 and/or bottom 52 panels to increase stiffness. Further stiffening may be provided by additional ribs.

Preferred dimensions for the block are 24 to 30 cm long by 12 to 15 cm wide and by 12 to 15 cm high. However, the size of the blocks is not restricted to any specific specifications, and may be changed according to the purpose. The same applies in relation to the shape of the block, and the blocks can be made in the shape of half-blocks, trapezoidal shapes, etc., so long as the blocks have top and bottom panels.

Protrusions 57 extend upwardly from the top panel 51 and are intended to inter-engage in receptacles or sockets 65 in the bottom panel 52 and collectively serve as attachment or coupling means. While the protrusions 57 are shown as being on the top, this may be revised so the protrusions are on the bottom with the receptacles 65 on the top. Both configurations are equivalent.

A preferred configuration for the protrusions 57 is to have a single row, centered on the longitudinal middle or median line 59 within the longitudinal median plane of the block 50 and symmetrically disposed about the transverse middle or median line 58 within the transverse median plane of the block 50.

While four protrusions 57 are shown, it is only essential for at least the outer two protrusions 57 to be present. These should be positioned near the outer ends of the block 50 to ensure inter-engagement of overlapping course of blocks. The inclusion of further protrusions 57 along the central median line 59 of the block 50 will render the coupling of blocks 50 more secure, and stiffen planar wall sections when such are constructed.

Figure 2:
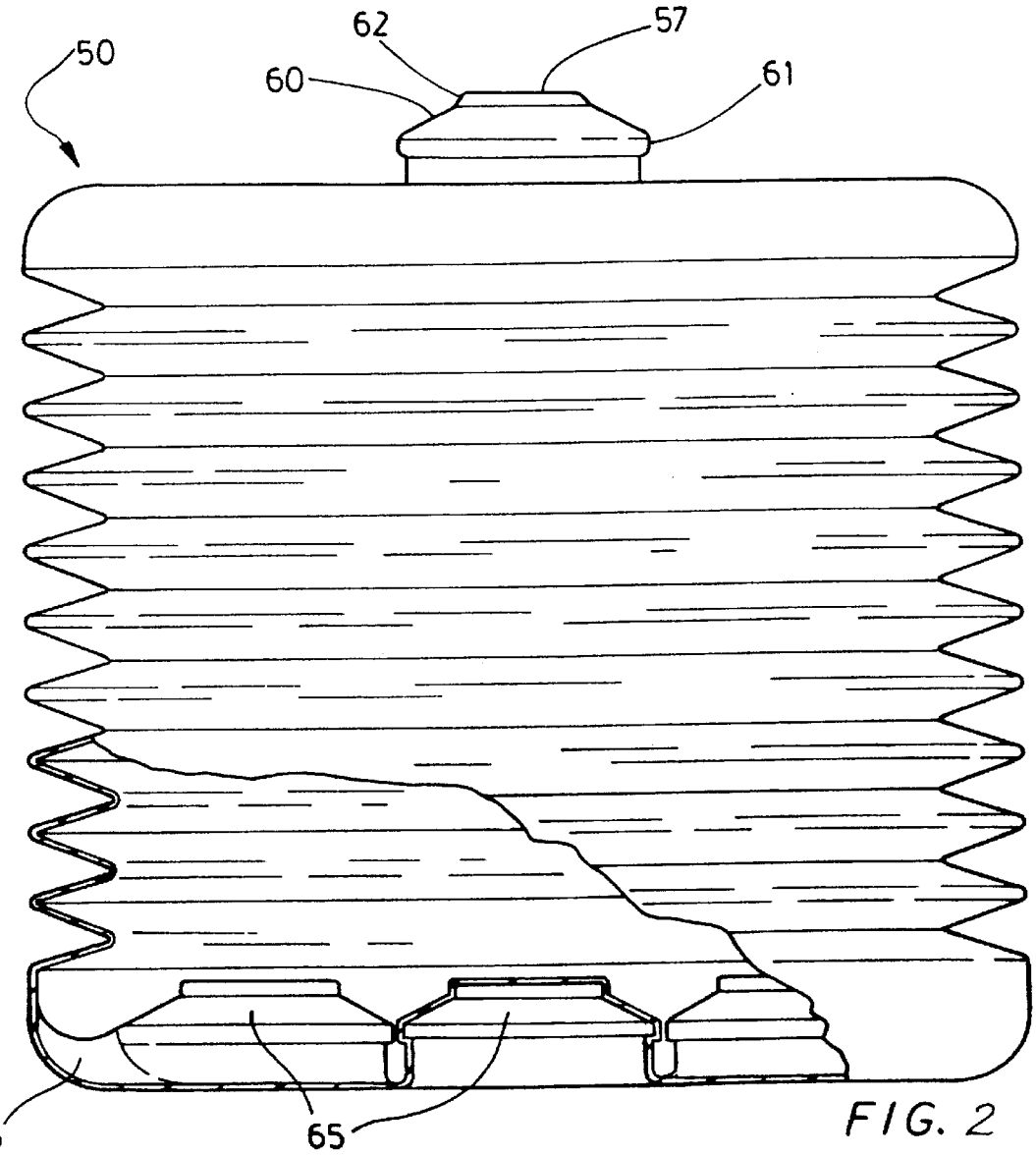
FIG. 2 is a cut-away end view of the embodiment of FIG. 1.

In FIG. 2 a profile end view of the block 50 shows that the protrusion 57 may have a tapered upper edge or shoulder 60 and a lip 61 to assist in assembly and in providing positive attachment.

Figure 4:
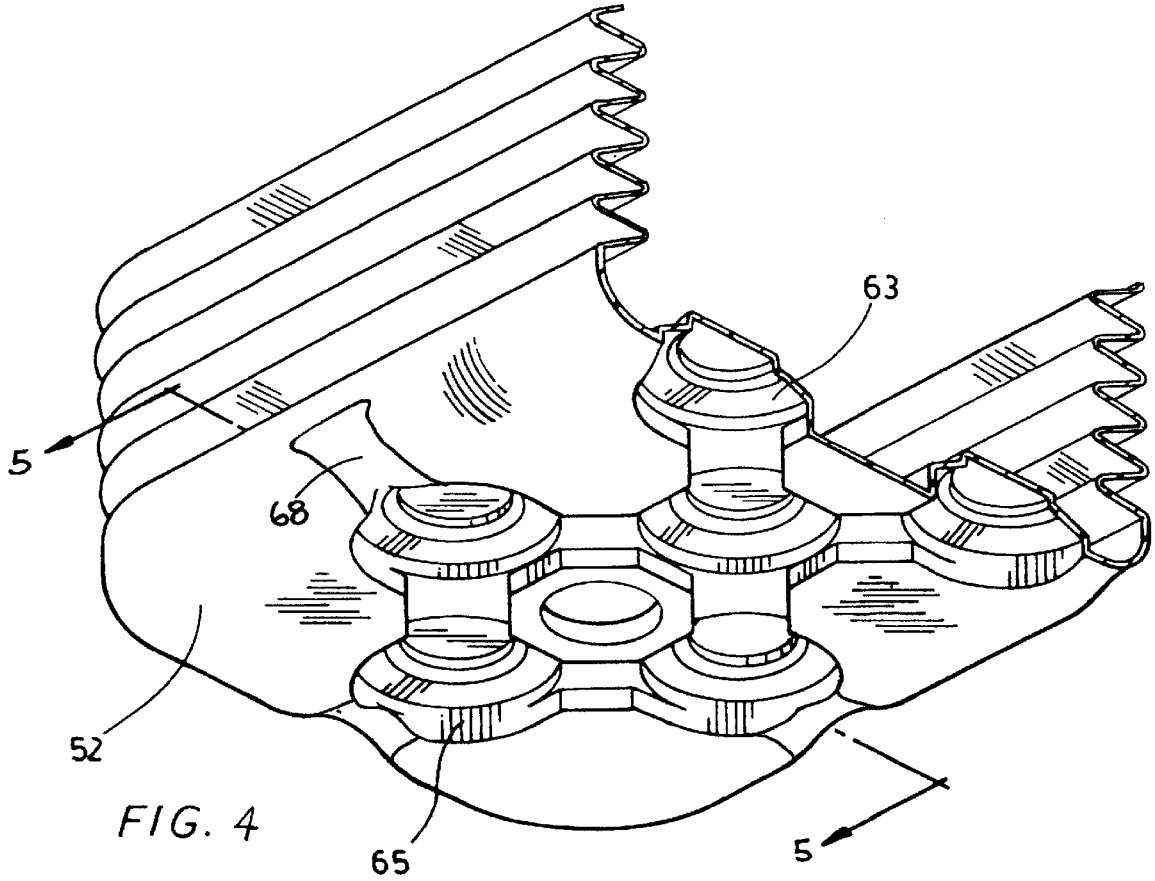
FIG. 4 is a perspective view of the bottom of a cross-sectioned block as in FIGS. 1–3.
Figure 5:
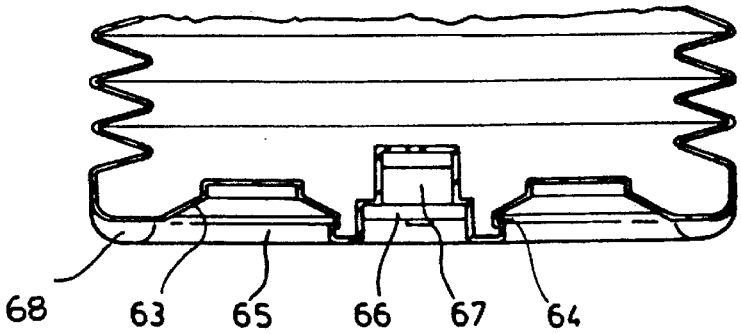
FIG. 5 is a detailed cross-section of the receptacle depressions formed in the bottom of the block of FIG. 4.

In FIGS. 4 and 5 the lower panel 52, with its protrusion-receiving receptacles in the form of discrete, recesses or sockets 65, is depicted. While sockets 65 are shown, channels that interengage with the protrusions 57 will perform equivalently.

The sockets 65 each have a tapered socket shoulder 63 to receive the tapered shoulder 60 on the protrusion 57. The perimeter, or rim 72, of each socket 65 need not be continuous and may be intermittent so long as it provides an engagement with the protrusion 57. Grooves 64 at the perimeter of the socket shoulder 63 may be employed to engage the lips 61. These grooves 64 are shown as being provided with a circular rim 72. This rim 72 may be interrupted to form a series of protruding lugs 73 shown in one example in FIG. 8. Such lugs 73 will expand and release more readily than a continuous rim.

A sealable orifice in the form of valve well 66 is provided with a preferably self-closing valve 67 at its end, although a manually sealable orifice may also be employed. This valve 67 may be opened, as by a pencil or finger, to allow air or other flowable substances to enter or escape from the block. Although shown in FIG. 8 in the bottom panel, this valve 67 may be located else where on the block.

As shown in FIGS. 2, 4, 5 and 6 (only), the sides 53 of the block 50 are optionally provided with notches 68 along the perimeter of the bottom panel 52 to receive fingers during separation and disassembly of the blocks. These may be positioned opposite in line with, and may extend through to, the sockets 65. In so extending, the notches 68 may penetrate or interrupt the socket rim 72. The extension of these notches 68 in this manner is helpful in producing the block 50 by blow-molding.

Figure 6:
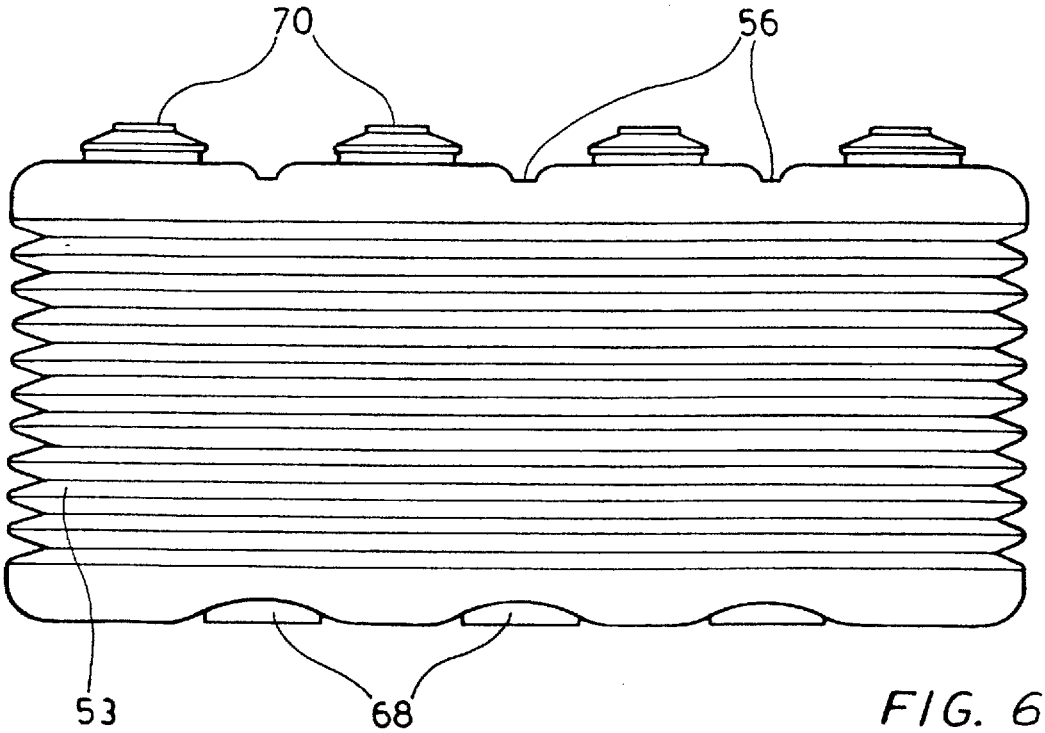
FIG. 6 is a face view of the block of FIG. 1 showing four coupling posts positioned on the top of the block.
Figure 7:
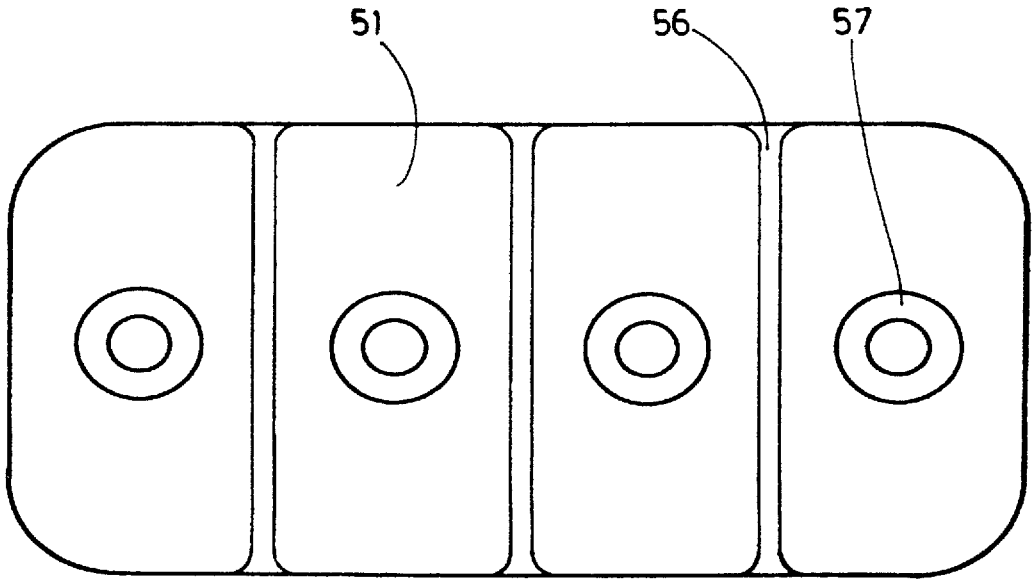
FIG. 7 is a top view of FIG. 6.
Figure 6A:
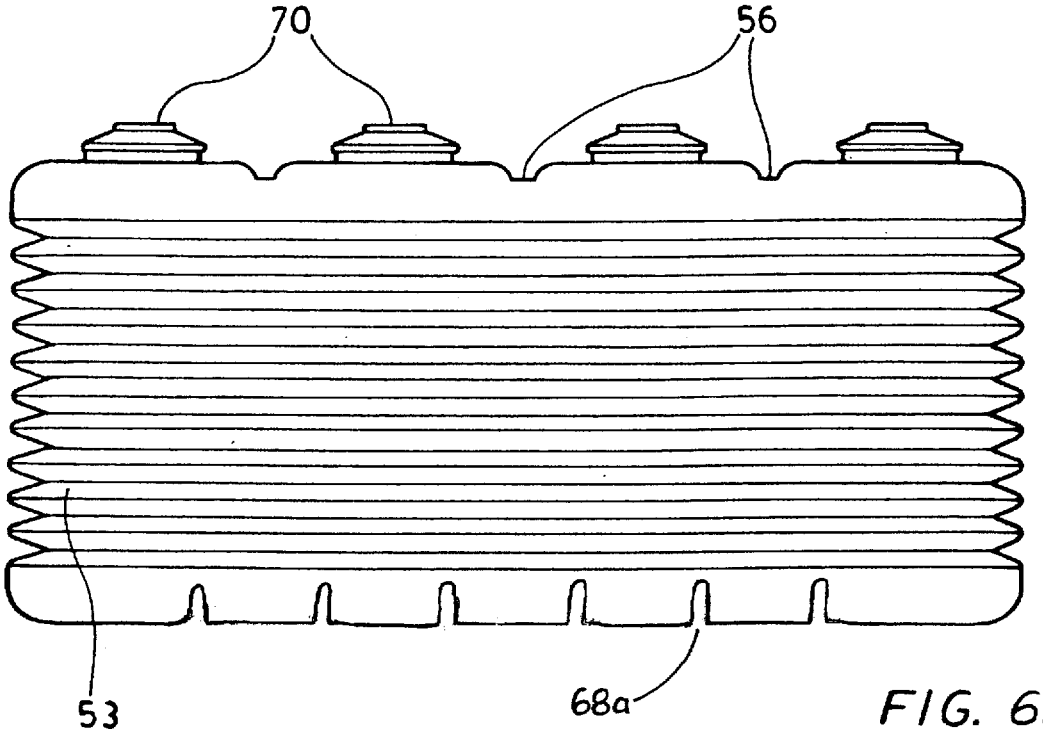
FIG. 6A is a detail of FIG. 6 showing dual grooves in place of finger notches.

As an alternative to the notches 68 of the form best depicted in FIG. 6, dual grooves 68*a* as depicted in FIG. 6A may be provided. These grooves 68*a* will be formed by corresponding ridges present in any mold used to form the block, as by blow-molding. The presence of such ridges in the mold is helpful to prevent the parison from being excessively stretched during blow-molding.

Optional stiffening ribs 56, in the form of a depressed groove as shown in FIG. 1, preferably extend to the outer edge of the block 50 where they can be seen. Such ribs 56 may alternately be elevated above the top face 51 of the block 50. By locating the ribs 56 at regularly spaced intervals, their outer ends serve as alignment guides for fitting the protrusions 57 into the receptacles 65.

Figure 8:
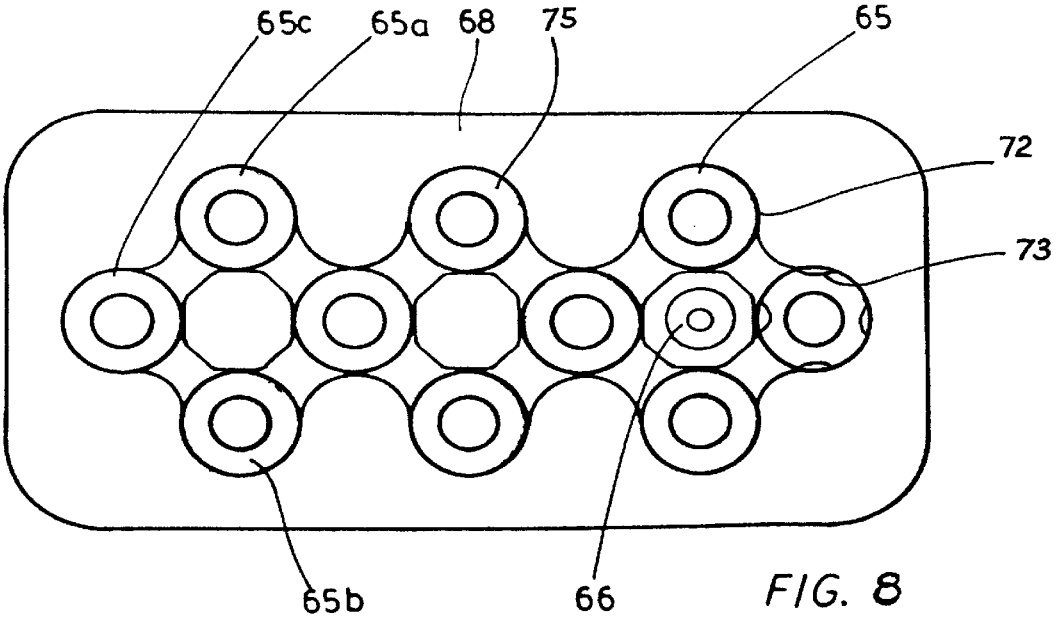
FIG. 8 is a bottom view of the block of FIGS. 1 and 7.

The sockets 65 may be laid-out in a multiple, overlapping cross-format, best seen in FIG. 8. This pattern of sockets 65 allows the blocks to be oriented at 90 degrees, if two sockets 65*a*, 65*b* are engaged by protrusions 57; or to swing over a range of degrees if a end socket 65*c* only is engaged by a single end protrusion 57. This range of motion may be limited by interference between the first unengaged protrusion 57*a* and the bottom face 52 of an adjacent block. Nevertheless, it allows blocks to be assembled in a curved fashion. This allows for more complex structures to be formed than that of a simple, planar wall.

The socket 65 pattern of FIG. 8 depicts ten sockets 65. Of these the two sets of four sockets 65, each deployed in a cross-like formation are preferred when the blocks being coupled are provided with four protrusions. The two additional central sockets 75 are optional. These central sockets 75 allow blocks with two or four protrusions to be engaged centrally to provide "T" junction.

The minimum essential sockets 65 are the six sockets 65 located adjacent the block perimeter, with two sockets 65*c* located along the median longitudinal plane, and four sockets 65*a*, 65*b* located on the two transverse 58*a*, 58*b* planes that separate the two outside quarters of the block 50 from its central portions.

Blocks according to the invention are suited to be easily stacked up by children. If the blocks are of the collapsible form depicted, children may construct larger toy play structures than traditional sized blocks, optionally large enough to walk-into. They may also be used to create functional structures that benefit from the insulating qualities of air-filled blocks. The hollow variant blocks of the invention may also be filled with water, sand or other flowing materials for such applications as flood or military use.

Such hollow blocks enjoy the advantage of being light and compact to store and transport. If made of polymer plastic, they are generally weather-proof. A further advantage is that when produced on a mass basis, such blocks should be relatively inexpensive.

However, the invention is not restricted to hollow, collapsible or inflatable blocks but resides in the complementary pattern of protrusions and receptacles as described.

Conclusion

The foregoing has constituted a description of specific embodiments showing how the invention may be applied and put into use. These embodiments are only exemplary. The invention in its broadest, and more specific aspects is further described and defined in the claims which now follow.

These claims and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property are claimed as follows:

1. A modular building block for constructing structures comprising:

(1) upper and lower faces on such block;

(2) upper and lower surfaces on said upper and lower faces which permit said block to be stacked with other blocks to form a vertical wall;

(3) coupling means associated with each block or engaging the block with another block, said coupling means being provided on the upper and lower faces of the block, positioned to render such blocks inter-engageable in staggered, over-lying courses to form a stable structure, wherein said coupling means comprises protrusions and receptacles that are of inter-engaging shapes dimensioned to mutually couple with each other, and wherein:

(a) the block has a longitudinal median plane, a transverse median plane dividing the block into two halves, and two quartering transverse planes that divide said halves respectively into quarters of said block;

(b) at least two protrusions are positioned on one first face of the upper and lower faces of the block along the longitudinal median plane of the block, symmetrically about the transverse median plane of the block;

(c) at least six receptacles are positioned on the other of said upper and lower faces of the block, opposite said first face, being thereby on a second face of said block, two of said receptacles being located along said longitudinal median plane of the block, symmetrically about the transverse median plane, and four of said receptacles being located in pairs along said respective two quartering transverse planes of the block, symmetrically about the longitudinal median plane to permit an engagement between blocks that allows respective blocks to be laid-up in overlapping courses, and wherein said second face carrying said receptacles is delimited by a perimeter, there being present pairs of grooves formed along said perimeter of said second face, said grooves extending inwardly from said perimeter to intersect with said receptacles formed within said second face of the block.

2. A modular building block for constructing structures, having upper and lower faces and longitudinal and transverse median planes comprising coupling means associated with each block for engaging the block with another block and positioned to render such blocks inter-engageable in staggered, over-lying courses to form a stable structure, wherein:

(1) said coupling means comprises protrusions and receptacles formed on the top and bottom faces of the block, such protrusions and receptacles being dimensioned to mutually intercouple with each other and being respectively located so as to permit overlapping interengagement between blocks in successive courses within a wall, (2) said protrusions comprising four protrusions positioned on one face of the block along the longitudinal median plane of the block, symmetrically about the transverse median plane of the block; and (3) said receptacles comprising eight receptacles, positioned on the opposed face of the block to the face having protrusions, the eight receptacles being in two cross-like formations of four receptacles, symmetrically located about the transverse median plane of the block so as to provide four receptacles positioned in a single row, along the longitudinal median plane of the block, wherein said opposite face carrying said receptacles is delimited by a perimeter, there being present pairs of grooves formed along said perimeter of said opposite face, said grooves extending inwardly from said perimeter to intersect with said receptacles formed within said second face of the block.

* * * * *